US006431843B1

(12) United States Patent
Dudley

(10) Patent No.: US 6,431,843 B1
(45) Date of Patent: Aug. 13, 2002

(54) METHOD OF ENSURING OPTIMUM VISCOSITY TO COMPRESSOR BEARING SYSTEM

(75) Inventor: Kevin F. Dudley, Cazenovia, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/738,680

(22) Filed: Dec. 15, 2000

(51) Int. Cl.[7] ..... F04B 49/00

(52) U.S. Cl. ..... 417/281; 417/902; 417/13; 417/410.1

(58) Field of Search ..... 417/281, 902, 417/53, 13, 410.1

(56) References Cited

U.S. PATENT DOCUMENTS 5,215,444 A * 6/1993 Bishoff ..... 417/281

FOREIGN PATENT DOCUMENTS

| | | |
|---|---|---|
| JP | 4-313645 | * 11/1992 |
| JP | 2000-120542 | * 4/2000 |
| JP | 2000-145600 | * 5/2000 |

* cited by examiner

*Primary Examiner*—Charles G. Freay
*Assistant Examiner*—Michael K. Gray
(74) *Attorney, Agent, or Firm*—Carlson, Gaskey & Olds

(57) ABSTRACT

A method of ensuring adequate oil thickness for the bearings in a sealed compressor includes the step of monitoring the viscosity of a lubricant for the bearings. If the monitored viscosity drops below a minimum, then some control is effected to reduce the necessary bearing film thickness. In a preferred embodiment, an unloader valve is opened to reduce the load on the bearings.

11 Claims, 2 Drawing Sheets

METHOD OF ENSURING OPTIMUM VISCOSITY TO COMPRESSOR BEARING SYSTEM

BACKGROUND OF THE INVENTION

This invention relates to a system which monitors the viscosity of the lubricant in a compressor and takes corrective action should that viscosity fall below a desired level.

Compressors as typically utilized to compress a refrigerant such as in an air conditioning system are typically sealed in a housing. A suction refrigerant passing to the compressor will often pass within the interior of the housing and over the compressor motor through a suction port in a compressor pump unit. The refrigerant is compressed and driven through an outlet port to a downstream location such as a condenser. Compressors are often provided with a passage which selectively connects the discharge passage back to the suction passage. A valve typically closes the connecting passage, but may be selectively opened under certain system conditions. This valve is typically known as an unloader valve.

A motor is typically housed within the sealed housing, and drives the compressor pump unit. A series of bearings supports a shaft driven by the motor to drive the compressor pump unit. These bearings are typically provided with a lubricant which is received in a sump in the housing, and which is driven throughout the housing during operation of the compressor. The lubricant serves to cool and lubricate the bearings.

As system conditions change, the viscosity of the lubricant can change. In particular, as the lubricant heats its viscosity will change. Moreover, the necessary or minimum viscosity which would be desirable at the bearings will also vary as the operating conditions of the compressor change. As an example, should the speed of the motor or the load on the compressor pump unit increase, a desired minimum viscosity of lubricant will also change. In the prior art, the viscosity of the lubricating oil has sometimes become too low to adequately lubricate the bearings. Bearing damage and subsequent failure has sometimes resulted.

Another factor effecting the viscosity of the lubricant is that in the basic type of compressor described above, refrigerant also circulates with the lubricating oil. The oil can sometimes be diluted by liquid refrigerant, which can also lower the viscosity of the mixture.

The viscosity relates to a minimum oil thickness at the bearings. The compressor bearings, which are typically journal bearings, depend on a hydro-dynamic oil film to prevent metal-to-metal contact. The necessary oil film thickness is dependent on a number of factors including the dimension of the bearings, the speed of the shaft rotation, the viscosity of the oil and the load on the bearing. The several variables which interact as described above have sometimes resulted in the viscosity of the oil being insufficient to adequately protect a bearing. The present invention is directed to addressing the situation when the viscosity of the lubricant in a sealed compressor becomes too low.

SUMMARY OF THE INVENTION

In the disclosed embodiment of this invention, a control monitors the viscosity of the oil. The control is provided with a minimum viscosity for the particular compressor. If the detected viscosity drops below the minimum required viscosity, some corrective action is taken by the control. In a preferred embodiment, an unloader valve is opened. When the unloader valve is opened, the load on the compressor significantly decreases. This thus reduces the required viscosity and reduces the likelihood of any bearing damage due to the low viscosity. Also, unloaded operation may allow the viscosity to increase.

In a method according to the present invention, the viscosity of the oil in a compressor is periodically measured. The measured viscosity is compared to a minimum viscosity value. If the detected viscosity is above the minimum value, sensing simply continues. If however the viscosity is below a safe limit, then a corrective action is taken. While the corrective action can be as simple as stopping operation of the motor, in a preferred embodiment an unloader valve is opened. After the unloader valve is opened, the viscosity continues to be measured. Once the viscosity again increases above a safe limit, the unloader valve may be closed and the system can return to normal monitoring operation.

In a most preferred embodiment of this invention, the control also monitors aspects of the operation of the compressor such as the speed, etc. to define the minimum viscosity value. Moreover, the controller will typically be designed for each individual compressor such that the controller and its minimum viscosity values take into account the specific geometry etc. of the bearings utilized in the particular compressor.

These and other features of the present invention can be best understood from the following specification and drawings, the following of which is a brief description.

DETAILED DESCRIPTION OF A PREFERRED EMBODIMENT

Figure 1:
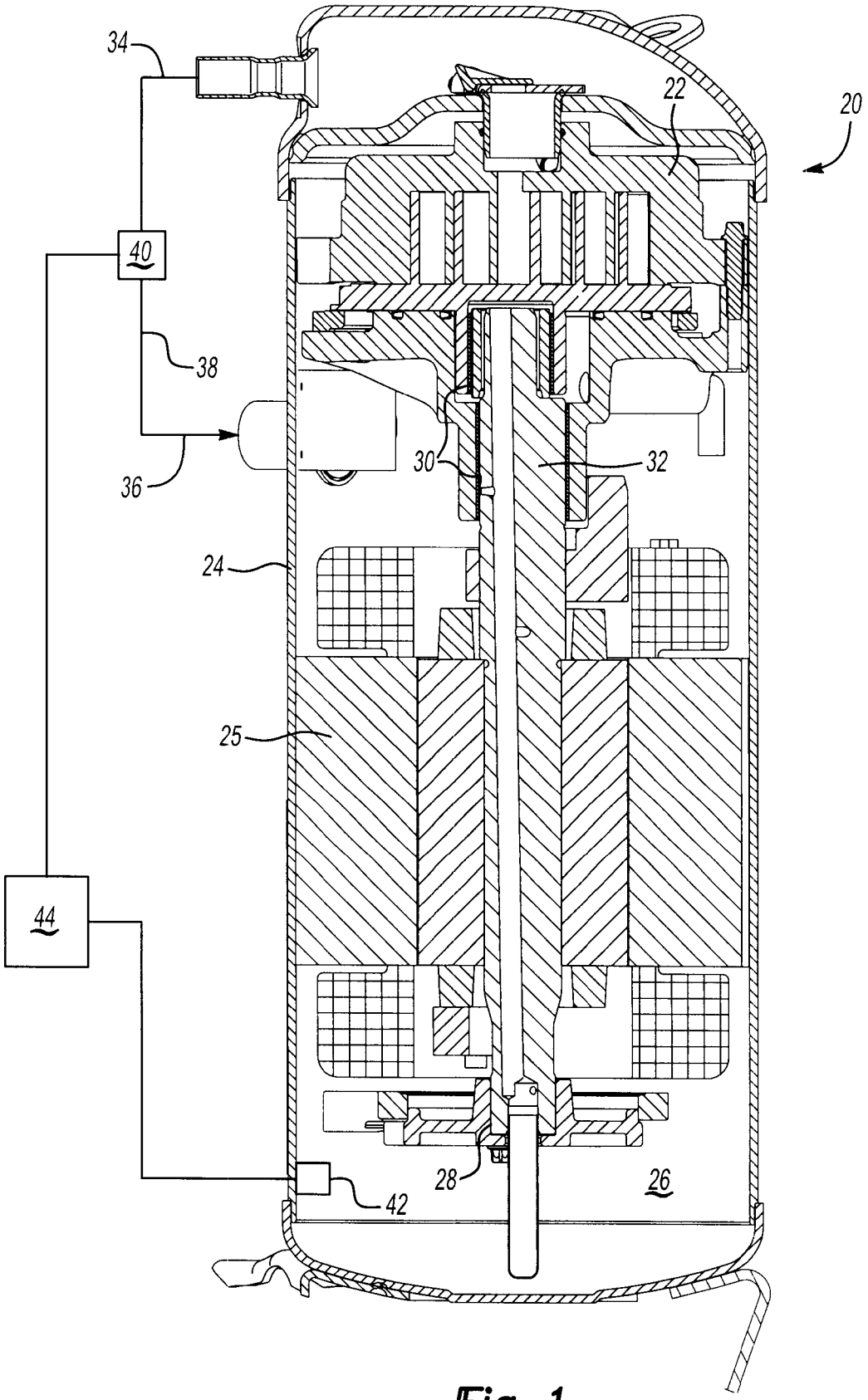
FIG. 1 is a schematic view of a compressor incorporating this invention.

As shown in FIG. 1, a compressor 20 incorporates a compressor pump unit 22 received within a sealed housing 24. An electric motor 25 drives a shaft 32 to rotate and drive the compressor pump unit. Bearings 28 and 30 mount the shaft within a housing. A discharge port 34 leads to a downstream user of the compressed refrigerant, typically a condenser. A suction port 36 leads from an upstream refrigerant cycle component, typically the condenser or an intermediate suction valve.

As known, an unloader passage 38 selectively communicates the discharge passage 34 to the suction passage 36. While the passage is shown external to the housing 24, such passages are often incorporated into the housing. A valve 40 is placed on the passage 38 and communicates with a controller 44. The valve may be selectively open to communicate discharge compressed refrigerant from passage 34 back to suction passage 36. The unloader valve is opened during typical cycling of the compressor when the necessary refrigerant load is low. Thus, if the necessary amount of compressed refrigerant decreases the unloader valve 40 may be opened to decrease the amount of refrigerant which is compressed. The present invention utilizes the opening of the valve to correct an undesirable system condition.

A oil sump 26 is found within the housing 24 and contains a lubricant. A viscosity sensor 42 communicates with controller 44, and measures the viscosity of the lubricant. While the viscosity sensor 42 is shown within the sump 26 other locations may perhaps be utilized for the sensor.

The sensor communicates the viscosity level of the oil to the controller. The controller will compare that viscosity level to a predetermined minimum viscosity level for safe operation of the compressor and protection of the bearings 28 and 30. If the viscosity level falls below the minimum level, then the unloader valve 40 is opened. While a first type of rotary compressor (a scroll compressor) is illustrated in FIG. 1, it should be understood that the present invention would have application in any type of sealed compressor.

By opening the unloader valve 40 the load on the compressor is significantly reduced. A quantity known as the Sommerfeld number relates several variables as shown below:

Bearing characteristic number, $$S = \left(\frac{r}{c}\right)^2 \mu \frac{N}{P}$$

$S$ = Sommerfeld No.
$r$ = bearing radius
$C$ = bearing clearance
$\mu$ = viscosity
$N$ = rotation speed
$P$ = bearing load The Sommerfeld number can be associated with a minimum film thickness variable of the oil or lubricant, which relates the ratio of the oil film thickness to a bearing clearance. As the Sommerfeld number increases, the minimum film thickness relative to the bearing clearance also increases. However, as is clear from the equation, if the bearing load decreases with decreasing viscosity, the Sommerfeld number can be held constant.

As can also be appreciated from the equation set forth above, the rotation speed of the shaft also has some effect in the minimum viscosity. The controller 44 may be sophisticated enough such that it takes in a speed input, or some related feedback, and changes the minimum viscosity to actuate the unloader based upon this detected variable. Alternatively, the minimum viscosity could be a set value for the particular compressor.

Figure 2:
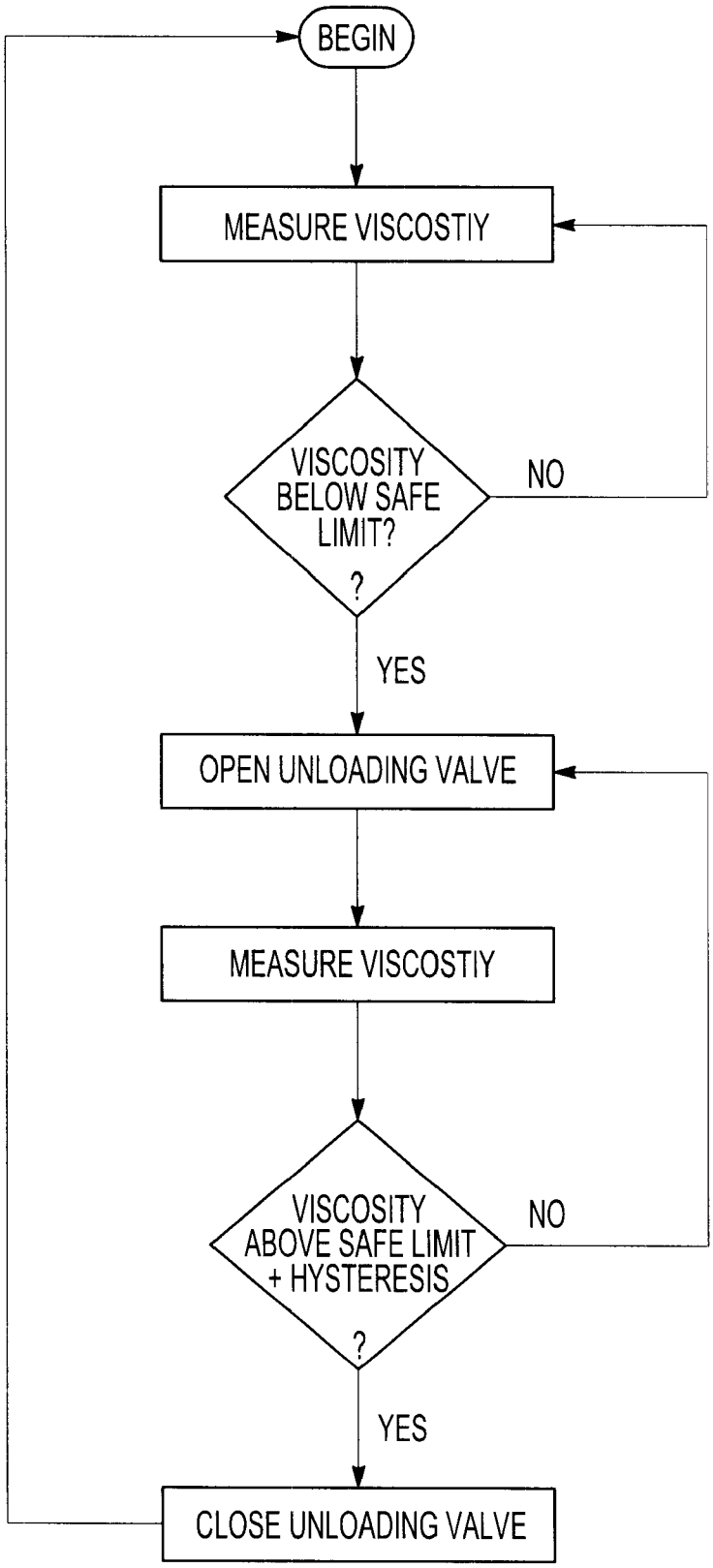
FIG. 2 is a flowchart.

As shown in FIG. 2, a method of operating this invention begins with the step of measuring the viscosity, which is done on an ongoing basis. If the viscosity is determined to be above a safe limit, the system continues in a closed loop. If however the viscosity is determined to be below a safe limit, the unloader valve is opened. The viscosity continues to be measured with the unloader valve opened. If the viscosity remains below the safe limit, then the unloader valve is maintained open. Once the viscosity again moves above the safe limit, the controller 44 closes the unloader valve and returns to normal monitoring operation. As noted in the flowchart, the second step of determining the viscosity safe limit would include a hysteresis number to prevent excessive cycling of the unloader valve.

As set forth above, the present invention is directed to addressing any potential detrimental effect from lower viscosity in a compressor lubricant. While preferred embodiments of this invention have been disclosed it should be understood that several modifications would come within the scope of this invention. As simple and very apparent modifications, other types of sealed compressors may benefit from this invention. Moreover, other control functions, such as simply stopping operation of the motor 25, may replace the opening of the unloader valve.

Thus, the claims should be studied to determine the true scope and content of this invention.

What is claimed is:

1. A sealed compressor comprising:

a housing incorporating an electric motor and a compressor pump unit, a shaft driven by said electric motor for driving said compressor pump unit being an oil sump being defined within said sealed housing; and a viscosity sensor for measuring the viscosity of a lubricant in said sealed housing, said viscosity sensor communicating with a controller, said controller being operable to compare a sensed viscosity to a minimum viscosity and effect a control operation should the sensed viscosity be below said minimum viscosity, said shaft including at least a pair of bearings mounting said shaft adjacent said compressor pump unit, and said minimum viscosity is determined to ensure an adequate oil thickness for said bearing, and said control operation being an operation which reduces a bearing load on said bearings.

2. A sealed compressor comprising:

a housing incorporating an electric motor and a compressor pump unit, a shaft driven by said electric motor for driving said compressor pump unit being an oil sump being defined within said sealed housing;

a viscosity sensor for measuring the viscosity of a lubricant in said sealed housing, said viscosity sensor communicating with a controller, said controller being operable to compare a sensed viscosity to a minimum viscosity and effect a control operation should the sensed viscosity be below said minimum viscosity; and said controller opens an unloader valve for communicating a discharge line to a suction line if a sensed viscosity is below a minimum viscosity.

3. A compressor as set forth in claim 1, wherein said compressor pump unit is a rotary compressor.

4. A compressor as set forth in claim 1, wherein said viscosity sensor is mounted within an oil sump in said housing.

5. A compressor as set forth in claim 2, wherein said shaft includes at least a pair of bearings mounting said shaft adjacent said compressor pump unit, and said minimum viscosity is determined to ensure an adequate oil thickness for said bearings.

6. A compressor as set forth in claim 1, wherein said control operation is opening an unloader valve to communicate a higher pressure refrigerant line to a lower pressure refrigerant line.

7. A compressor comprising:

a housing incorporating an electric motor and a compressor pump unit, a shaft being driven by said electric motor for driving said compressor pump unit, said shaft being supported in bearings, an oil sump being defined within said sealed housing; and a viscosity sensor for measuring the viscosity of a lubricant in said sump, said viscosity sensor communicating with a controller, said controller being operable to compare a sensed viscosity to a minimum viscosity for ensuring adequate oil thickness to said bearings and said controller opening an unloader valve should the sensed viscosity be below said minimum viscosity, said unloader valve communicating a first higher pressure refrigerant line to a lower pressure refrigerant line.

8. A compressor as set forth in claim 7, wherein said first line is at discharge pressure and said second line is suction pressure.

9. A method of operating a sealed compressor comprising the steps of:

1) providing a sealed compressor including a motor for driving a compressor pump unit, and said sealed housing providing an oil sump, and providing a viscosity sensor for sensing the viscosity of a lubricant in said oil sump.

2) operating said compressor and sensing a viscosity of a lubricant in said sump;

3) comparing said sensed viscosity to a minimum viscosity, and effecting a control operation if said sensed viscosity is below a minimum viscosity, said control operation including opening an unloader valve to communicate a higher pressure refrigerant line to a lower pressure refrigerant line if said sensed viscosity is below minimum viscosity.

10. The method of claim 9, wherein the monitoring of said viscosity continues after the opening of said unloader valve, and said unloader valve is closed after said viscosity returns to be above said minimum viscosity.

11. The method of claim 9, wherein said unloader valve communicates a discharge pressure line to a suction pressure line.

* * * * *